US006971612B1

(12) United States Patent
Wilson-Lowery

(10) Patent No.: US 6,971,612 B1
(45) Date of Patent: Dec. 6, 2005

(54) BABY BOTTLE HOLDER

(76) Inventor: Veronica Wilson-Lowery, 1750 Scenic View Ct., San Leandro, CA (US) 94577

( * ) Notice: Subject to any disclaimer, the term of this patent is extended or adjusted under 35 U.S.C. 154(b) by 0 days.

(21) Appl. No.: 10/716,088

(22) Filed: Nov. 18, 2003

Related U.S. Application Data

(63) Continuation-in-part of application No. 10/080,635, filed on Feb. 22, 2002, now abandoned.

(51) Int. Cl.[7] ..... A47D 15/00
(52) U.S. Cl. ..... 248/104; 248/106; 248/205.2
(58) Field of Search ..... 248/103, 104, 248/106, 160, 102

(56) References Cited

U.S. PATENT DOCUMENTS

| | | | | |
|---|---|---|---|---|
| 753,683 | A | 3/1904 | Dixon | |
| 1,688,765 | A * | 10/1928 | Veras | 248/103 |
| 1,987,132 | A | 1/1935 | Shine | |
| 3,161,392 | A | 12/1964 | Kopec et al. | |
| 4,114,847 | A | 9/1978 | Bogensberger | |
| 4,320,883 | A | 3/1982 | Bass | |
| 4,809,938 | A * | 3/1989 | Skinner et al. | 248/102 |
| 4,989,811 | A | 2/1991 | Millis et al. | |
| 5,083,732 | A | 1/1992 | Akamine | |
| 5,135,189 | A * | 8/1992 | Ghazizadeh | 248/104 |
| 5,192,041 | A | 3/1993 | Bryant | |
| D345,423 | S * | 3/1994 | Sabalones | D24/199 |
| D369,413 | S | 4/1996 | Lodewyck, Jr. et al. | |
| 5,603,479 | A | 2/1997 | Kristy | |
| 5,775,654 | A | 7/1998 | Price | |
| 5,873,551 | A | 2/1999 | Jones | |
| 6,138,882 | A | 10/2000 | Buettner | |
| 6,581,886 | B1 * | 6/2003 | Suh | 248/104 |
| 2003/0218105 | A1 * | 11/2003 | Sones et al. | 248/104 |

* cited by examiner

*Primary Examiner*—Ramon O Ramirez

(57) ABSTRACT

A bottle holder for supporting a bottle on a surface is disclosed, and comprises a pad portion for resting on the surface and bottle securing structure positioned on a face of the pad portion for removably securing the bottle in position on the pad portion. A second embodiment of the bottle holder supports a bottle on a support, and comprises a stalk portion having first and second ends and a bottle securing structure mounted on the first end of the stalk portion for securing to the bottle.

13 Claims, 8 Drawing Sheets

BABY BOTTLE HOLDER

CROSS REFERENCE TO RELATED APPLICATION

This application is a continuation-in-part of application Ser. No. 10/080,635, filed Feb. 22, 2002 now abandoned.

BACKGROUND OF THE INVENTION

1. Field of the Invention

The present invention relates to bottle supports and more particularly pertains to a new baby bottle holder for holding and supporting baby bottles during use.

2. Description of the Prior Art

The use of bottle supports is known in the prior art. More specifically, bottle supports heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,114,847; U.S. Pat. No. 3,161,392; U.S. Pat. No. 5,192,041; U.S. Pat. No. 4,320,883; U.S. Pat. No. 753,683; U.S. Pat. No. Des. 369, 413; and U.S. Pat. No. 1,987,132.

While these devices fulfill their respective, particular objectives and requirements, the aforementioned patents do not disclose a new baby bottle holder. The inventive device includes a first bottle holder assembly including a base connection member, a bottle connection member, and a formable extension member; and a bottle propping assembly having a pillow portion and a pair of straps coupled to the pillow portion which form a pair of aligned loops such that the straps are designed for holding a baby bottle against the pillow portion.

In these respects, the baby bottle holder according to the present invention substantially departs from the conventional concepts and designs of the prior art, and in so doing provides an apparatus primarily developed for the purpose of holding and supporting baby bottles during use.

SUMMARY OF THE INVENTION

In view of the foregoing disadvantages inherent in the known types of bottle supports now present in the prior art, the present invention provides a new baby bottle holder construction wherein the same can be utilized for holding and supporting baby bottles during use.

The general purpose of the present invention, which will be described subsequently in greater detail, is to provide a new baby bottle holder apparatus and method which has many of the advantages of the bottle supports mentioned heretofore and many novel features that result in a new baby bottle holder which is not anticipated, rendered obvious, suggested, or even implied by any of the prior art bottle supports, either alone or in any combination thereof.

To attain this, the present invention generally comprises a bottle holder for supporting a bottle on a surface, and includes a pad portion for resting on the surface and bottle securing structure positioned on a face of the pad portion for removably securing the bottle in position on the pad portion.

A second embodiment of the bottle holder supports a bottle on a support, and comprises a stalk portion having first and second ends and a bottle securing structure mounted on the first end of the stalk portion for securing to the bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby bottle holder apparatus and method which has many of the advantages of the bottle supports mentioned heretofore and many novel features that result in a new baby bottle holder which is not anticipated, rendered obvious, suggested, or even implied by any of the prior art bottle supports, either alone or in any combination thereof.

It is another object of the present invention to provide a new baby bottle holder which may be easily and efficiently manufactured and marketed.

It is a further object of the present invention to provide a new baby bottle holder which is of a durable and reliable construction.

An even further object of the present invention is to provide a new baby bottle holder which is susceptible of a low cost of manufacture with regard to both materials and labor, and which accordingly is then susceptible of low prices of sale to the consuming public, thereby making such baby bottle holder economically available to the buying public.

Still yet another object of the present invention is to provide a new baby bottle holder which provides in the apparatuses and methods of the prior art some of the advantages thereof, while simultaneously overcoming some of the disadvantages normally associated therewith.

Still another object of the present invention is to provide a new baby bottle holder for holding and supporting baby bottles during use.

Yet another object of the present invention is to provide a new baby bottle holder which includes a first bottle holder assembly including a base connection member, a bottle connection member, and a formable extension member; and a bottle propping assembly having a pillow portion and a pair of straps coupled to the pillow portion which form a pair of aligned loops such that the straps are designed for holding a baby bottle against the pillow portion.

Still yet another object of the present invention is to provide a new baby bottle holder that helps reduce spills.

Even still another object of the present invention is to provide a new baby bottle holder that aids parents in feeding infants while driving.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those forth above will become apparent when consideration is given to the following detailed description thereof. Such description makes reference to the annexed drawings wherein.

DESCRIPTION OF THE PREFERRED EMBODIMENT

Figure 1:
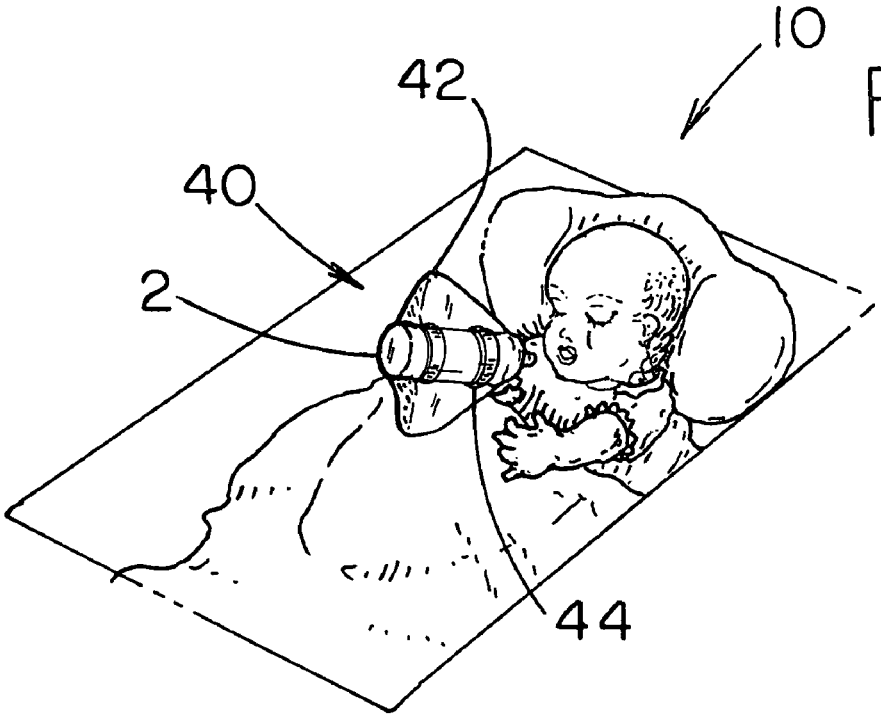
FIG. 1 is a schematic perspective view of a new baby bottle holder according to the present invention in use.
Figure 2:
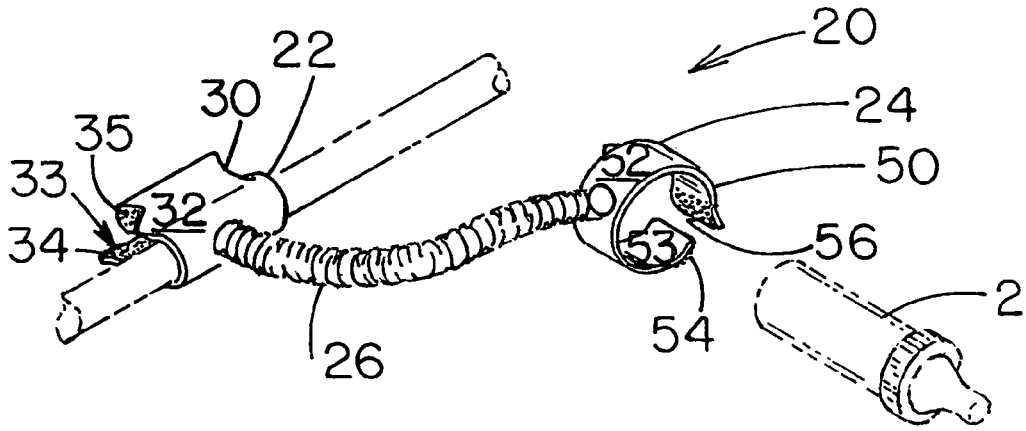
FIG. 2 is a schematic perspective view of another embodiment of the present invention.
Figure 3:
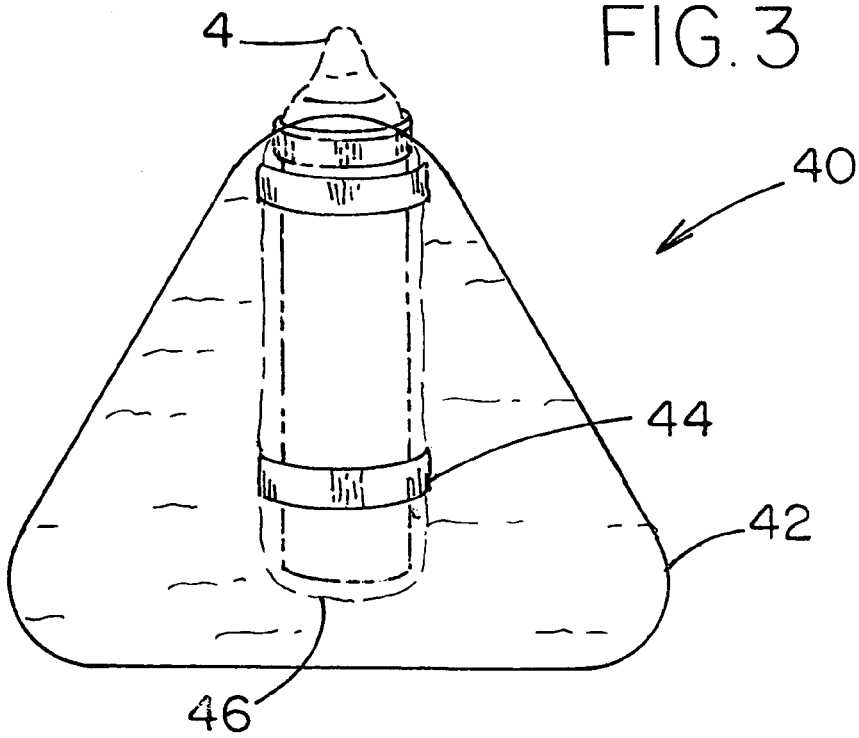
FIG. 3 is a schematic top view of the embodiment of the present invention shown in FIG. 1.
Figure 4:
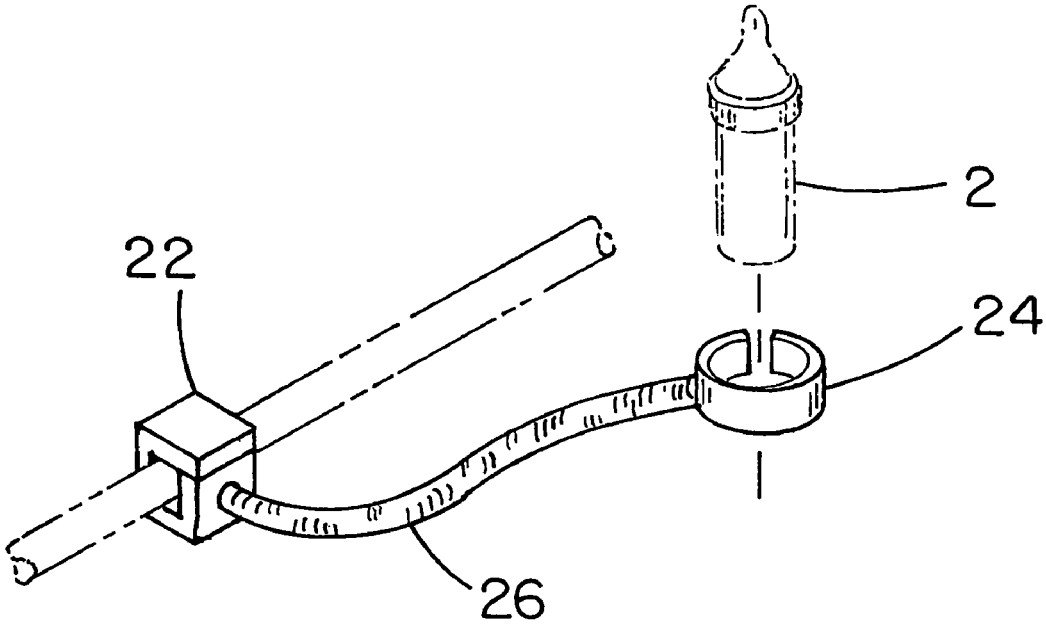
FIG. 4 is a schematic perspective view of another embodiment of the present invention.

With reference now to the drawings, and in particular to FIGS. 1 through 9 thereof, a new baby bottle holder embodying the principles and concepts of the present invention and generally designated by the reference numeral 10 will be described.

As best illustrated in FIGS. 1 through 4, the baby bottle holder 10 generally comprises a first bottle holder assembly 20 and a bottle propping assembly 40.

The first bottle holder assembly 20 includes a base connection member 22, a bottle connection member 24, and a formable extension member 26.

The base connection member 22 is a flexible planar sheet 30. The extension member 26 is coupled to a first face 32 of the planar sheet 30. A portion of hook fastener 34 extends from a second face 33 of the planar sheet 30 for coupling the planar sheet 30 to a surface.

A portion of loop fastener 35 extends from the planar sheet 30 and is engageable to the portion of hook fastener 34. Thus the planar sheet 30 is couplable around a structure.

The bottle connection member 22 is a flexible planar sheet 50. The extension member 26 is coupled to a first face 52 of the planar sheet 50. A portion of hook fastener 54 extends from a second face 53 of the planar sheet 50.

A portion of loop fastener 56 extends from the planar sheet 50 and is engageable to the portion of hook fastener 54. Thus the planar sheet 50 is designed for coupling around a baby bottle 2.

The bottle propping assembly 40 includes a pillow portion 42 and a pair of straps 44 coupled to the pillow portion 42. The straps 44 form a pair of aligned loops. Thus, the straps 44 are designed for holding a baby bottle 2 against the pillow portion 42.

The pillow portion 42 includes a groove 46. Each of the straps 44 includes ends positioned on sides of the groove 46. Thus, the baby bottle 2 is held in the groove 46 when the straps 44 hold the baby bottle 2 against the pillow portion 42.

The pillow portion 42 is generally triangular. The groove 46 extends inwardly from an apex of the pillow portion 42 such that a nipple 4 of the baby bottle 2 extends outwardly from the apex of the pillow portion 42 when the straps 44 hold the baby bottle 2 against the pillow portion 42.

Figure 5:
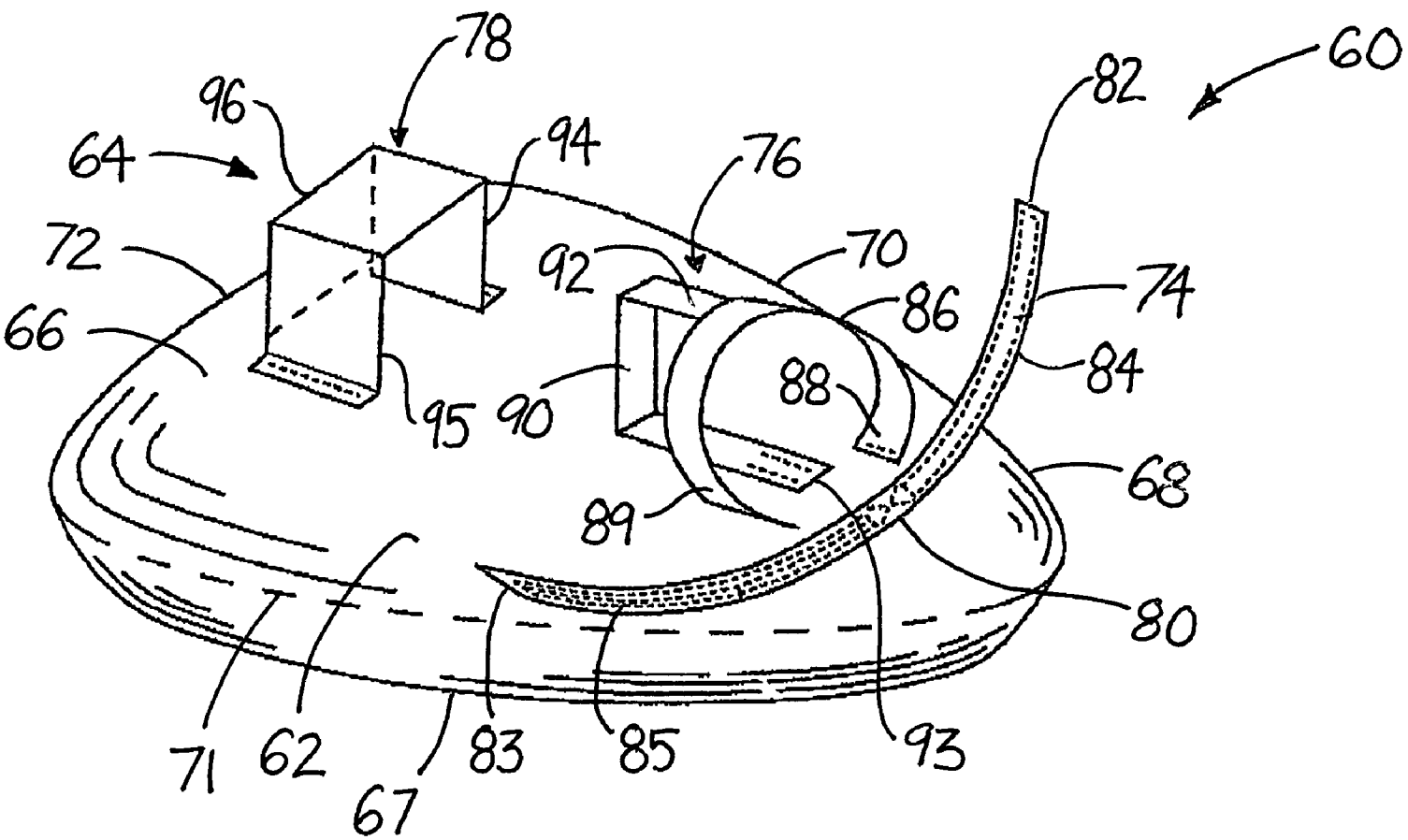
FIG. 5 is a schematic perspective view of a further embodiment of the bottle holder of the present invention.
Figure 6:
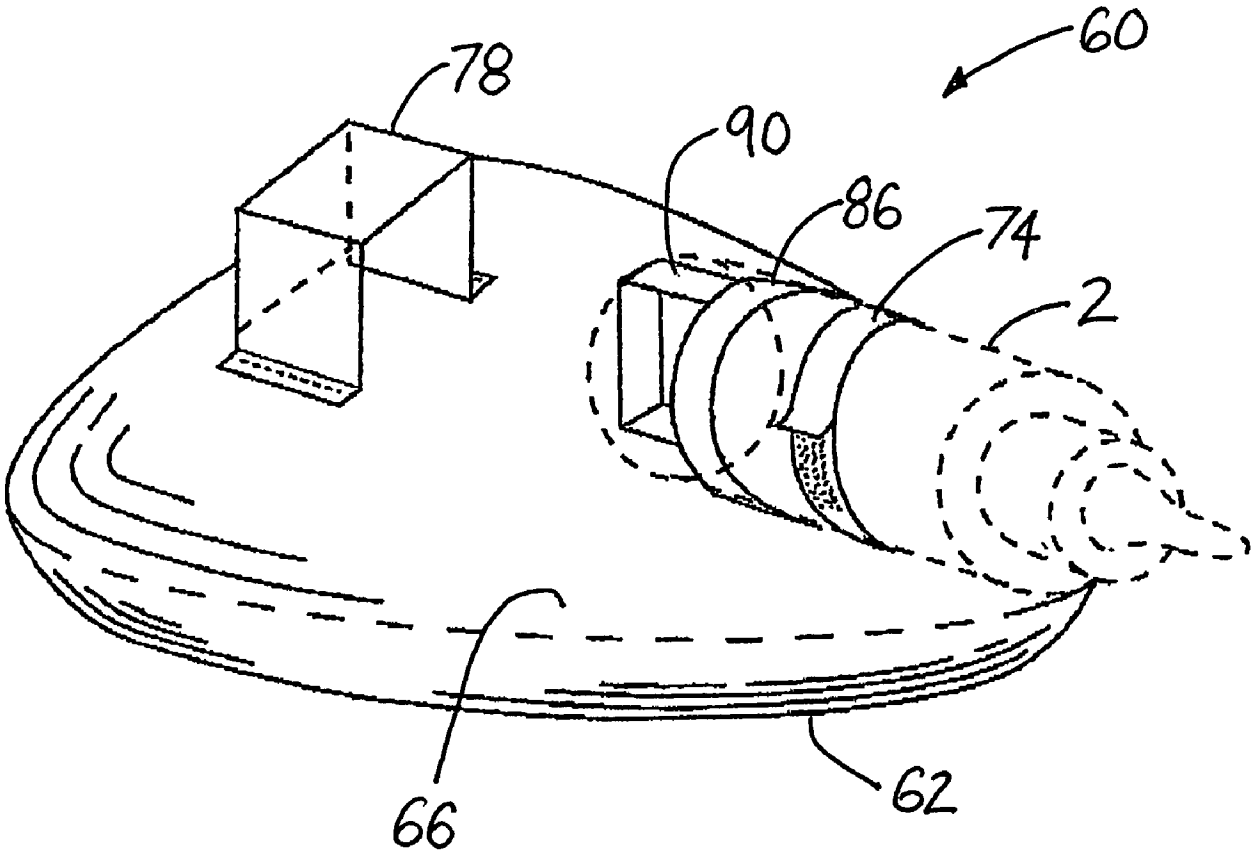
FIG. 6 is a schematic perspective view of the embodiment of the present invention shown in FIG. 4 with a relatively short bottle mounted thereon.
Figure 7:
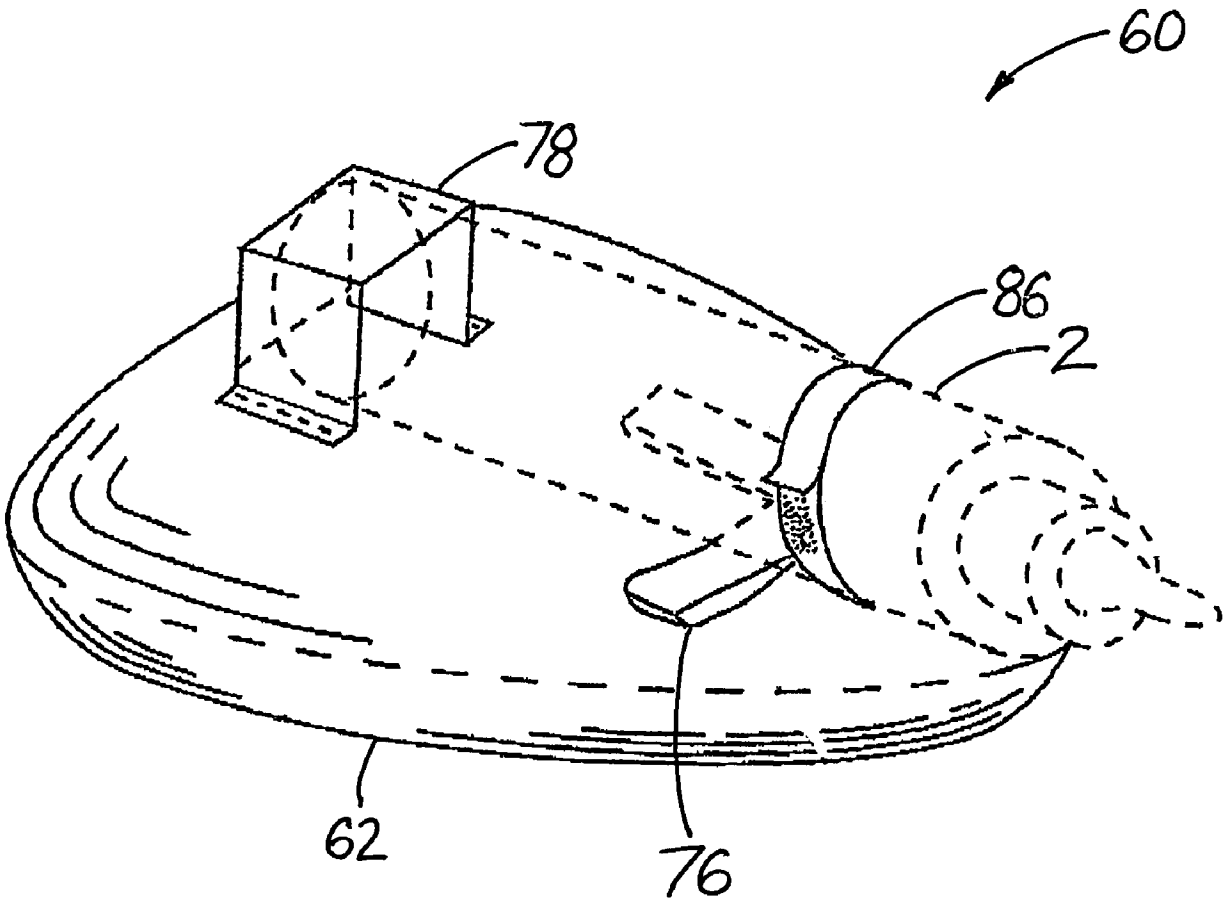
FIG. 7 is a schematic perspective view of the embodiment of the present invention shown in FIG. 4 with a relatively long bottle.

In another implementation of the invention shown in FIGS. 5 through 7, a bottle holder 60 is provided for supporting a bottle 2 on a surface. The bottle holder 60 may comprise a pad portion 62 and bottle securing means 64. The pad portion 62 of the bottle holder 60 is suitable for resting on the surface, and may include an upper face 66 and a lower face 67. The pad portion may also have a perimeter 68 between the upper 66 and lower 67 faces. The perimeter 68 may have an apex 69, and may also have a pair of side portions 70, 71 and a back portion 72. The side portions 70, 71 of the perimeter 68 may converge at the apex 69, and the perimeter may be substantially triangular in shape.

The bottle securing means 64 is suitable for removably securing the bottle 2 in position on the pad portion 62. The bottle securing means 64 may be positioned on the upper face 66 of the pad portion 62. In one embodiment of the invention, the bottle securing means 64 includes a bottle securing strap 74, a first bottom stop 76, and a second bottom stop 78.

The bottle securing strap 74 may be mounted on the upper face 66 of the pad portion 62 for releasably securing about an upper location on the bottle 2. The bottle securing strap 74 may have a medial portion 80 and a pair of end portions 82, 83. The medial portion 80 of the bottle securing strap 74 may be mounted on the pad portion 62 and the end portions 82, 83 may be free of the pad portion 62. Fastening means 84, 85 may be located on each of the end portions 82, 83 for releasably securing the end portions of the securing strap 74 together to form a loop about the bottle 2. In some embodiments of the invention, the fastening means may comprise portions of hook and loop fasteners.

The first bottom stop 76 may be mounted on the upper face 66 of the pad portion 62 for stopping the bottom of a relatively small bottle 2 when it is secured in the bottle securing strap 74. The first bottom stop 76 may be spaced from the bottle securing strap 74 at a first distance. The first bottom stop 76 may be formed of a flexible material so that the first bottom stop is collapsible against the upper face 66 of the pad portion 64. The first bottom stop 76 may comprise a loop member 86 for looping about a portion of the bottle 2, and the loop member 86 may have opposite ends 88, 89 that are fixed to the pad portion 64. The loop member 86 may be continuous between the opposite ends 88, 89. The first bottom stop 76 may also comprise a thong strap 90 extending between the loop member 86 and the pad portion 62, and a first end 92 of the thong strap may be mounted on a medial portion of the loop member 86 and a second end 93 of the thong strap being mounted on the upper face 66 of the pad portion 62. A length of the thong strap 90 may be greater than a distance from the medial portion of the loop member 86 to the upper face 66 of the pad portion 62 so that the thong strap is slack therebetween.

The second bottom stop 78 may also be mounted on the upper face 66 of the pad portion 62 for stopping the bottom of a relatively large bottle 2 secured in the bottle securing strap 74. The second bottom stop 78 may be spaced from the bottle securing strap 74 at a second distance, and the second distance may be greater than the first distance defined above. The second bottom stop 78 may comprise a top wall 92 and a pair of side walls 94, 95 that extend between the top wall 92 and the upper face 66 of the pad portion 62 for extending about a bottom portion of the bottle 2. The second bottom stop 78 may further include an end wall 96 that extends between the side walls 94, 95 and between the top wall 92 and the upper face 66 of the pad portion 62.

In the foregoing implementation of the invention, it will be realized that the invention is adaptable to hold bottles of both relatively longer and relatively shorter lengths simply by utilizing either the first 76 or the second 78 bottom stop. In the case of using the second bottom stop 78, the first bottom stop 76 may be collapsed against the upper face 66 of the pad portion 62 to permit the bottle 2 to extend over and past the first bottom stop 76 to the second bottom stop 78.

Figure 8:
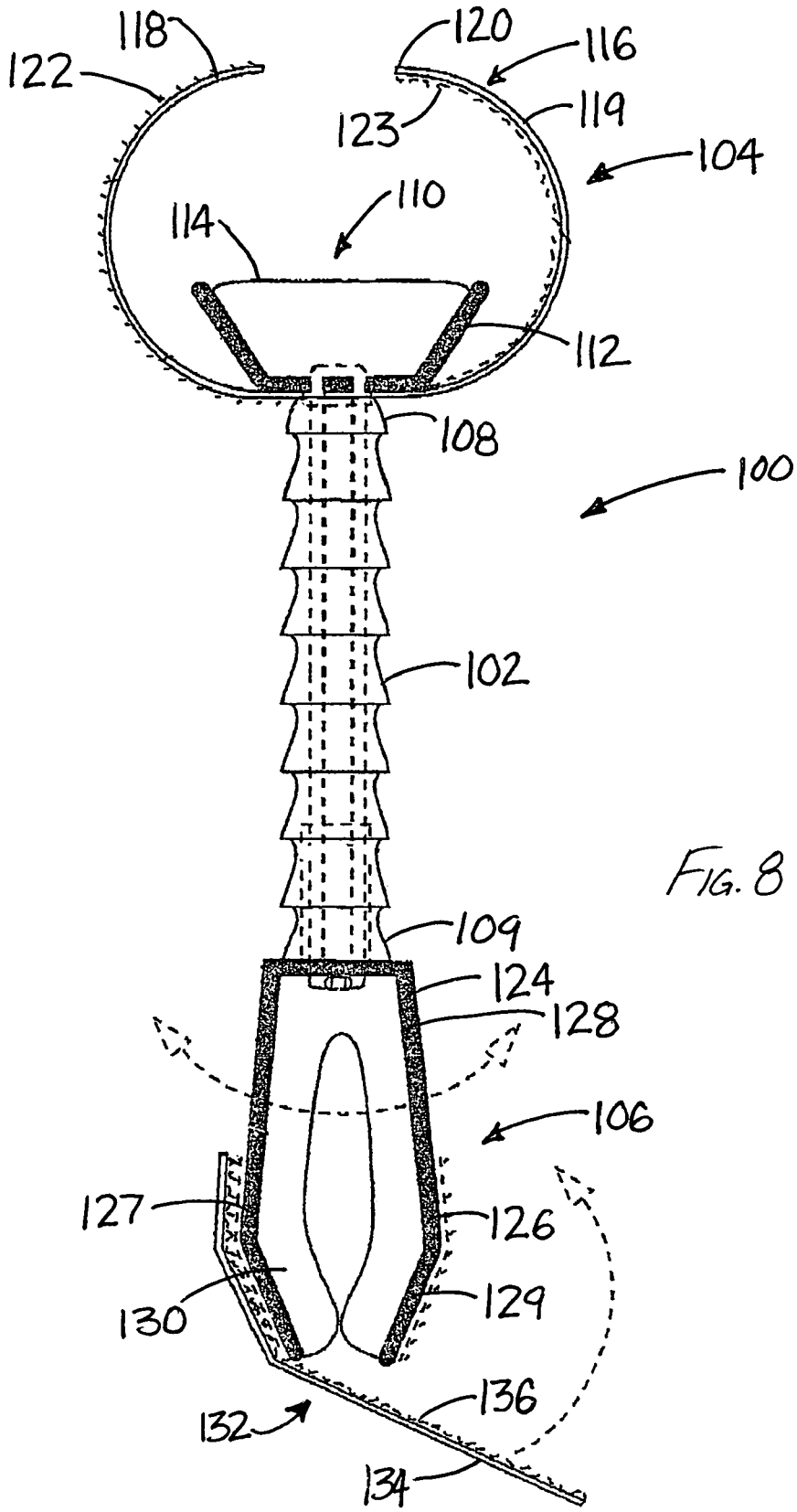
FIG. 8 is a schematic side view of a still further embodiment of the present invention.
Figure 9:
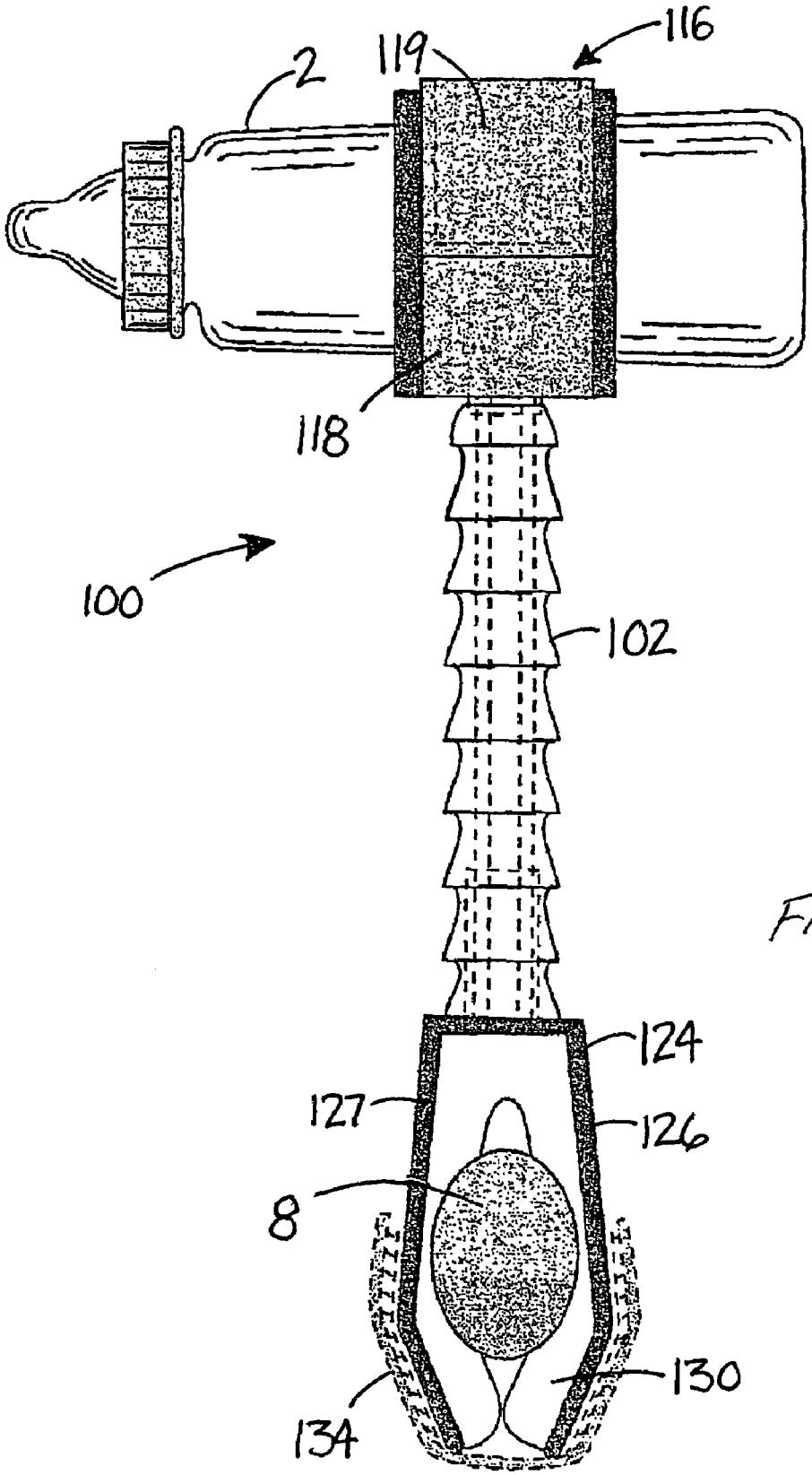
FIG. 9 is a schematic side view of the embodiment of the present invention shown in FIG. 7.

In another implementation of the invention shown in FIGS. 8 and 9, a bottle holder 100 is suitable for supporting a bottle 2 on a support 8. The bottle holder 100 may comprise a stalk portion 102, bottle securing means 104 for securing to the bottle 2, and support clamping means 106 for clamping on the support 8.

The stalk portion 102 may be flexible to bend upon application of force to the stalk portion and may be adapted to hold a particular bent position when the application of force is removed from the stalk portion. The stalk portion has first 108 and second 109 ends.

The bottle securing means 104 may be mounted on the first end 108 of the stalk portion 102, and may include a base pad 110 mounted on the first end 108. The base pad 110 may include a cup 112 and a resiliently compressible pad 114 positioned in the cup 112. The bottle securing means 104 may also comprise looping means 116 for looping about removably looping about the bottle. The looping means 116 may comprise a pair of strap portions 118, 119. The pair of strap portions 118, 119 may extend in diametrically opposite directions from the base pad 110. The pair of strap portions 118, 119 may each have a free end 120, and a fastening means 122, 123 may be being positioned on each of the free ends 120 of the strap portions 118, 119 for releasably fastening the free ends of the strap portions together to secure the bottle 2 against the base pad 110. In one embodiment of the invention, the fastening means 122, 123 may comprise hook and loop fasteners.

The support clamping means 106 mounted on the second end 109 of the stalk portion 102. The support clamping means 106 may comprise a clamp member 124 that is mounted on the second end 109 of the stalk portion 102. The clamp member 124 may have a pair of arms 126, 127 that extend away from the stalk portion 102, and the clamp member may be substantially U-shaped. Each arm of the pair of arms 126, 127 may have an inboard portion 128 and an outboard portion 129. The inboard portions 128 of the arms 126, 127 diverge as the inboard portions extend away from stalk portion 102 and the outboard portions 129 converge as the outboard portions extend away from the stalk portion.

The support clamping means 106 may further comprise padding 130 mounted on an interior of the clamp member 124 for positioning against the support 8. The padding 130 may extend along the arms 126, 127 of the clamp member 124. The support clamping means 106 may also comprise a clamping strap assembly 132 for releasably clamping the arms 126, 127 of the clamp member 124 toward each other. The clamping strap assembly 132 may include a clamping strap 134 for selectively extending about the support 8, and releasable fastening means 136 for releasably fastening the clamping strap 134 to the arms 126, 127 of the clamp member 124. The releasable fastening means 136 may be mounted on outer surfaces of each of the arms 126, 127 of the clamp member 124 and on a side of the clamping strap 134.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bottle holder for supporting a bottle on a support, comprising:

a stalk portion having first and second ends;

a bottle securing means mounted on the first end of the stalk portion for securing to the bottle; and a support clamping means mounted on the second end of the stalk portion for clamping the support;

wherein the bottle securing means includes a base pad comprising a cup and a resiliently compressible pad positioned in the cup;

wherein the support clamping means comprises:

a clamp member mounted on the second end of the stalk portion, the clamp member having a pair of arms extending away from the stalk portion; and a clamping strap assembly for releasably clamping the arms of the clamp member toward each other; and wherein the clamp member is substantially U-shaped, each arm of the pair of arms having a inboard portion and an outboard portion, the inboard portions of the arms diverging as the inboard portions extend away from stalk portion and the outboard portions converging as the outboard portions extend away from the stalk portion.

2. The bottle holder of claim 1 wherein the stalk portion is flexible to bend upon application of force to the stalk portion and being adapted to hold a position when the application of force is removed from the stalk portion.

3. The bottle holder of claim 1 wherein the bottle securing means further comprises looping means for removably looping about the bottle.

4. The bottle holder of claim 3 wherein the looping means comprises a pair of strap portions, the pair of strap portions extending in diametrically opposite directions from the base pad, the pair of strap portions each having a free end, the looping means further comprising fastening means being positioned on each of the free ends of the strap portions for releasably fastening the free ends of the strap portions together to secure the bottle against the base pad.

5. The bottle holder of claim 1 wherein the support clamping means additionally comprises padding mounted on an interior of the clamp member for positioning against the support.

6. The bottle holder of claim 1 wherein the clamping strap assembly comprises:

a clamping strap; and releasable fastening means releasably fastening the clamping strap to the arms of the clamp member, the releasable fastening means being mounted on outer surfaces of each of the arms of the clamp member and on a side of the clamping strap.

7. The bottle holder of claim 1 wherein the resiliently compressible pad substantially fills an interior of the cup.

8. A bottle holder for supporting a bottle on a support, comprising:

a stalk portion having first and second ends;

a bottle securing means mounted on the first end of the stalk portion for securing to the bottle; and a support clamping means mounted on the second end of the stalk portion for clamping the support;

wherein the stalk portion is flexible to bend upon application of force to the stalk portion and being adapted to hold a position when the application of force is removed from the stalk portion;

wherein the bottle securing means comprises:

a base pad mounted on the first end of the stalk portion; and looping means for looping about removably looping about the bottle;

wherein the base pad includes a cup and a resiliently compressible pad positioned in the cup;

wherein the looping means comprises a pair of strap portions, the pair of strap portions extending in diametrically opposite directions from the base pad, the pair of strap portions each having a free end, the looping means further comprising fastening means being positioned on each of the free ends of the strap portions for releasably fastening the free ends of the strap portions together to secure the bottle against the base pad;

wherein the support clamping means comprises:

a clamp member mounted on the second end of the stalk portion, the clamp member having a pair of arms extending away from the stalk portion; and a clamping strap assembly for releasably clamping the arms of the clamp member toward each other;

wherein the clamp member is substantially U-shaped, each arm of the pair of arms having a inboard portion and an outboard portion, the inboard portions of the arms diverging as the inboard portions extend away from stalk portion and the outboard portions converging as the outboard portions extend away from the stalk portion;

wherein the support clamping means additionally comprises padding mounted on an interior of the clamp member for positioning against the support; and wherein the clamping strap assembly comprises:

a clamping strap; and releasable fastening means releasably fastening the clamping strap to the arms of the clamp member, the releasable fastening means being mounted on outer surfaces of each of the arms of the clamp member and on a side of the clamping strap.

9. A bottle holder for supporting a bottle on a support, comprising:

a stalk portion having first and second ends;

a bottle securing means mounted on the first end of the stalk portion for securing to the bottle; and a support clamping means mounted on the second end of the stalk portion for clamping the support;

wherein the bottle securing means includes a base pad comprising a cup and a resiliently compressible pad positioned in the cup;

wherein the bottle securing means further comprises looping means for removably looping about the bottle;

wherein the looping means comprises a pair of strap portions, the pair of strap portions extending in diametrically opposite directions from the base pad, the pair of strap portions each having a free end, the looping means further comprising fastening means being positioned on each of the free ends of the strap portions for releasably fastening the free ends of the strap portions together to secure the bottle against the base pad.

10. The bottle holder of claim 9 wherein the stalk portion is flexible to bend upon application of force to the stalk portion and being adapted to hold a position when the application of force is removed from the stalk portion.

11. The bottle holder of claim 9 wherein the support clamping means comprises:

a clamp member mounted on the second end of the stalk portion, the clamp member having a pair of arms extending away from the stalk portion; and a clamping strap assembly for releasably clamping the arms of the clamp member toward each other.

12. The bottle holder of claim 11 wherein the support clamping means additionally comprises padding mounted on an interior of the clamp member for positioning against the support.

13. The bottle holder of claim 11 wherein the clamping strap assembly comprises:

a clamping strap; and releasable fastening means releasably fastening the clamping strap to the arms of the clamp member, the releasable fastening means being mounted on outer surfaces of each of the arms of the clamp member and on a side of the clamping strap.

* * * * *